United States Patent [19]

Ashinoff

[11] Patent Number: 4,947,438

[45] Date of Patent: Aug. 14, 1990

[54] FOREHEAD GUARD

[76] Inventor: Leslie A. Ashinoff, 1670 Cynron La., East Meadow, N.Y. 11554

[21] Appl. No.: 476,033

[22] Filed: Feb. 6, 1990

[51] Int. Cl.[5] ..... A42B 1/08

[52] U.S. Cl. ..... 2/181; 2/411; 2/410; 2/DIG. 11

[58] Field of Search ..... 2/181, 410, 411, 414, 2/418, 171.8, 171, 419, 425, 174, DIG. 11

[56] References Cited

U.S. PATENT DOCUMENTS

| | | | |
|---|---|---|---|
| 2,143,483 | 1/1939 | Iglauer | 2/411 |
| 4,062,067 | 12/1977 | Franzen | 2/410 |
| 4,613,993 | 9/1986 | Steele et al. | 2/411 |
| 4,646,367 | 3/1987 | El Hassen | 2/411 |
| 4,675,919 | 6/1987 | Heine et al. | 2/410 |
| 4,698,852 | 10/1987 | Romero | 2/411 |
| 4,910,804 | 3/1990 | Lidgren | 2/DIG. 11 |

FOREIGN PATENT DOCUMENTS

| | | | |
|---|---|---|---|
| 2134370 | 8/1984 | United Kingdom | 2/411 |

*Primary Examiner*—Werner H. Schroeder
*Assistant Examiner*—Gloria Hale

[57] ABSTRACT

A forehead guard consisting of a closed loop of a terrycloth or similar stretch material tube and an unattached semi-circular plastic shock-absorbing member within the tube adapted to assume a forehead position on the user while the terrycloth tube is stretched about the back of the user's head to complete the positioning thereof.

2 Claims, 1 Drawing Sheet

FOREHEAD GUARD

The present invention relates to a protective guard worn on the user's forehead, particularly to prevent reinjury to a previously sustained forehead trauma. Thus, the within inventive guard is, in effect, localized as to the protection it is intended to afford the user, and is characterized by the ease in which it is sized to fit, placed and held in its operative position protecting the forehead of the user.

EXAMPLES OF THE PRIOR ART

Steele, U.S. Pat. No. 4,613,993, issued on Sep. 30, 1986, discloses a protective headgear for children comprising a plurality of polyester filled tubular rings arranged concentrically to be held on the head by a chin strap. Because protection of the entire head area is attempted, the guard of this patent is worn on the user's head thus requiring appropriate sizing for proper fit, and the noted chin strap to hold the guard in place.

In contrast, the within forehead guard is worn in encirciling relation about the user's forehead, and contemplates a stretchable component to readily accommodate to different head and forehead sizes, so as to be worn without the discomfort of a chin strap.

El Hassan, U.S. Pat. No. 4,646,367, issued on Mar. 3, 1987, discloses a padded/protective headgear device for use by a child in tumbling exercises which does not require a chin strap. It comprises an elastic band 1, to which is fastened about its outer surface a series of padded parts 2, which are made from either dense foam or lined with a sheet of waterproof, flexible plastic material. The advantage for providing a comfortable fit using the elastic band of this patented device is significantly diminished however because of the attachment to this band of the padded parts which do not stretch and which, as a consequence, restrict the stretch of the band.

In the within inventive forehead guard, the shock-absorbing component is effectively assembled with a stretchable band component which provides the fit and positioning of the guard without interfering with the band providing these functions.

Generally, it is an object of the present invention to provide, to prevent forehead injuries, a forehead guard overcoming the foregoing and other shortcomings of the prior art.

Additionally, it is an object to provide a "one size fits all" type forehead guard that is effective as a cephalic protection means, and also has a conventional appearance of a headband, so as to minimize any self consciousness of its use, as well as having other signifiant benefits and advantages as will be described in greater detail subsequently herein.

The description of the invention which follows, together with the accompanying drawings should not be construed as limiting the invention to the example shown and described because those skilled in the art to which this invention appertains will be able to devise other forms thereof within the ambit of the appended claims.

Figure 1:
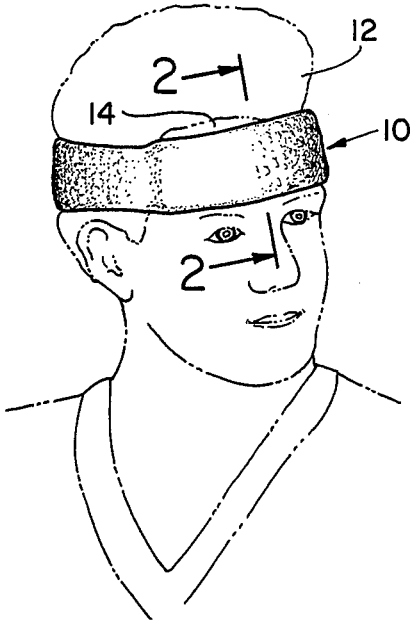
FIG. 1 is a perspective view of the within inventive forehead guard in use.

In FIG. 1 the protective guard 10 of the present invention is shown in its contemplated position about the user's forehead 12. While guard 10 appears to be a conventional headband, in reality, and as will be understood from the description which follows, it is a cephalic protection means to be used by one who is recovering from trauma to the forehead area 14.

As understood, most active people, particularly those in sports, invariably experience a painful cut, bruise, bump, laceration, contusion, have surgery or a skin eruption in a specific area of the forehead 12, herein designated 14. At some point during convalescense, the person will wish to resume a high level of activity, but fears reinjury to the recovering forehead location 14. Guard 10 is designed primarily to protect the tender area 14 from reinjury.

As in the case of a well known, conventional "sweat" band, the within guard 10 has an outer covering made of a length of seamless knit terry cloth tubing 16 or other soft type material characterized in that it is stretchable. More particularly, a seam 18 joins the edges 22 and 24 of the cloth to thereby convert the flat strip of cloth into a closed loop tubular configuration, but before the seam 18 is applied, there is positioned against the cloth so as to be an internal insert in an unattached relation within the resulting enclosing tube 16 an arcuate or semi-circular, semi-rigid shock-absorbing assembly 20.

In its preferred form, assembly 20 consists of a pliable or hand-shapable aluminum article of manufacture 32, commercially available as a so-called Conco Aumafoam Splint having adhesively secured to one side a shape-retaining member 28, and conventionally used to immobilize fractured fingers. The product aspects of member 26 to be noted which contributes to its inventive use as a component of the within inventive forehead guard 10 is that it is of a length and has a hand-shaped arcuate shape to correspond to the average size and shape forehead 12, and is made of a laminate material 30. Material 30 has a 4 inch (0.040") thick aluminum strip facing 32 adhesively secured to a 3/16" thick foam plastic padding 34, wherein the latter padding 34 can be made thicker or additional padding can be supplied by using an additional foam tubing member 28 of the type commercially available from Hernell Products, Inc., of Hartford, Connecticut. If used, tubing 28 is cut to be a little longer than the shaped shock-absorbing stiff member 26. Alternately padding 28 can be made of many layers of thin foam sheet wrapped about member 26.

Figure 2:
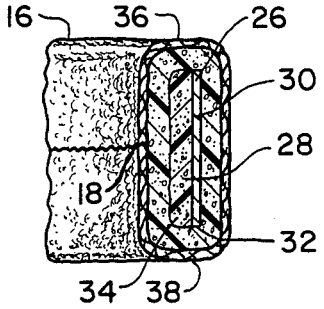
FIG. 2 is a cross sectional view taken on line 2—2 of FIG. 1 showing internal structural details; showing the components thereof in spaced relation.

However assembled, stiffening member 26 is enclosed within foam padding 28 and then further enclosed in outer covering 16 when seam 18 is applied, as best seen in FIG. 2. Seam 18 is preferably made along the interior surface of covering 16 but could just as well be made at upper locations 36 and 38. Alternately, only about 80% of seam 18 may be sewn, leaving a short open section to be sewn after assembly 20 has been inserted within covering 16.

Figure 4:
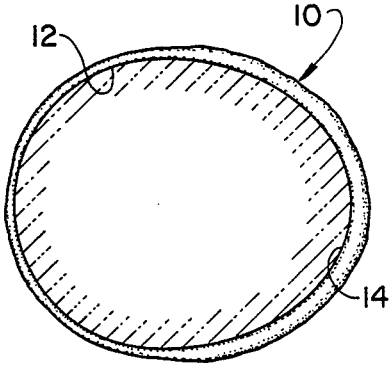
FIG. 4 is a schematic plan view illustrating the normal operative positive of the forehead guard during use according to the present invention.
Figure 3:
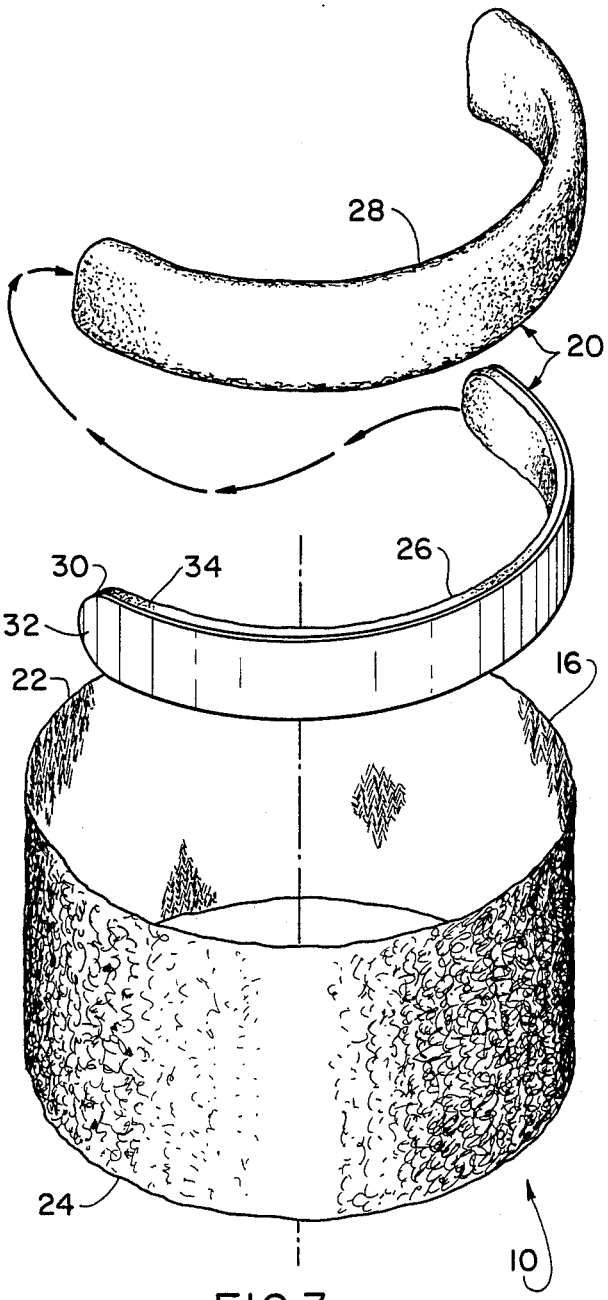

Underlying the present invention is the ease in which the guard 10 is sized for fit, placed and held in its operative position protecting the forehead of the user. From the preceding description it should be readily appreciated that the semi-circular shape of the internal assembled member 20 is adapted to mate the normal similar semi-circular forehead shape of the user so as to assume an operative position in which the foam padding on this member is pressed from within against the user's forehead, and the remaining portion of the closed loop of the outer tube 16 is then stretched relative to the internal member 20, from a smaller to an appropriately larger size because the two members 16 and 20 are not attached to each other, and is then placed behind the head of the user to thereby effectively hold the guard 10 in its protective position on the user's forehead 12 and over the forehead location 14 to be protected against shock and contact. The operative position of the guard 10 as just described is shown best in FIGS. 1 and 4.

Figure 5:
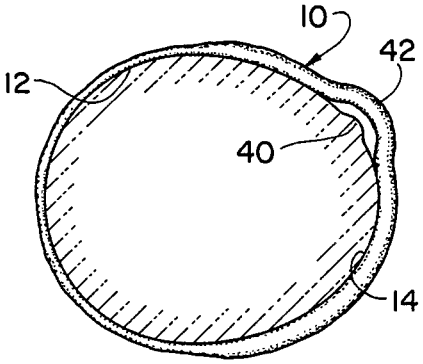
FIG. 5 is a view similar to FIG. 4 but showing a modified operative positive.

With some forehead injuries however, there may be some swelling in the user's forehead to be contended with, and with which contact must be obviated, even with respect to what normally would be the forehead-contacting inner surface of the guard outer tubular covering 16. Thus, should swelling remain from an injury or the wearer feel some discomfort, for example at location 40 designated in FIG. 5, even from the pressure of guard 10, he or she may shape in the member 26 a relief "bridge" 42 in the vicinity of the discomfort, thereby using to advantage that member 26 is shapable under moderate pressure and retains that shape afterwards.

While the particular forehead porotective guard and its method of assembly and construction herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. An improved forehead guard comprising the combination of an outer closed loop of a tubular member of stretchable construction material and disposed in unattached relation therein an internal semi-circular member with a foam covering, said internal member having an operative positive with said foam covering thereon pressed from within against the forehead of a user and said tubular member having an operative position with said closed loop portion thereof stretched relative to said internal member to a size so as to be disposed about the back of the head of said user, whereby said forehead guard is held in a protective position on the user's forehead.

2. The improved forehead guard as claimed in claim 1 including a foam pad within said outer tubular member in an interposed position between said internal member and an inner surface of the length portion of said tubular member that is positioned against the forehead of the user.

* * * * *